US005444202A

United States Patent [19]

Zurcher

[11] Patent Number: 5,444,202

[45] Date of Patent: Aug. 22, 1995

[54] ACTUATOR FOR ELECTRICAL SWITCHES

[75] Inventor: Ernst Zurcher, Oberentfelden, Switzerland

[73] Assignee: GEC Alsthom T&D AG, Obertenfelden, Switzerland

[21] Appl. No.: 118,840

[22] Filed: Sep. 10, 1993

[30] Foreign Application Priority Data

Sep. 10, 1992 [EP] European Pat. Off. ..... 92115463

[51] Int. Cl.[6] ..... H01H 5/00

[52] U.S. Cl. ..... 200/400; 200/425; 200/324

[58] Field of Search ..... 200/400, 401, 424, 425, 200/323, 324, 325; 335/171; 74/97, 98

[56] References Cited

U.S. PATENT DOCUMENTS

| | | | |
|---|---|---|---|
| 3,098,134 | 7/1963 | Nijland | 200/400 |
| 4,019,008 | 4/1977 | Kohler et al. | 200/400 |
| 4,100,582 | 8/1978 | Barkam | 200/400 |
| 4,137,436 | 1/1979 | Barkan et al. | 200/400 |
| 4,263,487 | 4/1981 | Welter et al. . | |
| 4,409,449 | 10/1983 | Takano et al. | 200/400 |
| 4,497,992 | 2/1985 | Kodera et al. . | |
| 4,578,551 | 3/1986 | Lin | 200/400 |
| 4,800,242 | 1/1989 | Yin | 200/400 |
| 4,916,268 | 4/1990 | Micoud et al. | 200/400 |
| 5,004,875 | 4/1991 | Moody et al. | 200/400 |
| 5,148,913 | 9/1992 | Bonnandel et al. | 200/400 |

FOREIGN PATENT DOCUMENTS

| | | |
|---|---|---|
| 1056668 | 5/1954 | France . |
| 486605 | 11/1929 | Germany . |
| 1040651 | 10/1958 | Germany . |
| 1236632 | 3/1967 | Germany . |
| 3217255 | 6/1983 | Germany . |

*Primary Examiner*—Renee S. Luebke
*Attorney, Agent, or Firm*—Keck, Mahin & Cate

[57] ABSTRACT

An actuator for the rapid connection and disconnection of a switch (10) has a primary shaft (12), which can be rotated to and fro between a first end setting (18) and a second end setting (18') and possesses a tension lever (16). Seated in a rotationally secure manner on a delivery shaft (14) parallel to the primary shaft (12) is the drive shaft (22), which can be rotated, under the force of the spring-loading arrangement (26), from the disconnect setting (24) into the connect setting (24') and back. The spring-loading arrangement (26) includes a helical spring (28), which acts as a pre-tensioned compression spring and is supported by its spring ends (36, 36') on a respective butt strap (32, 34), which butt straps in turn interact, via driving stops (52, 54, 56, 58), with the tension lever (16) and the drive lever (22). A locking device supports the delivery shaft (14) in its disconnect and connect settings (24, 24') counter to the force of the helical spring (28), which can be tensioned upon the rotation of the primary shaft (12), until the primary shaft (12) has reached the corresponding unlatching setting.

10 Claims, 4 Drawing Sheets

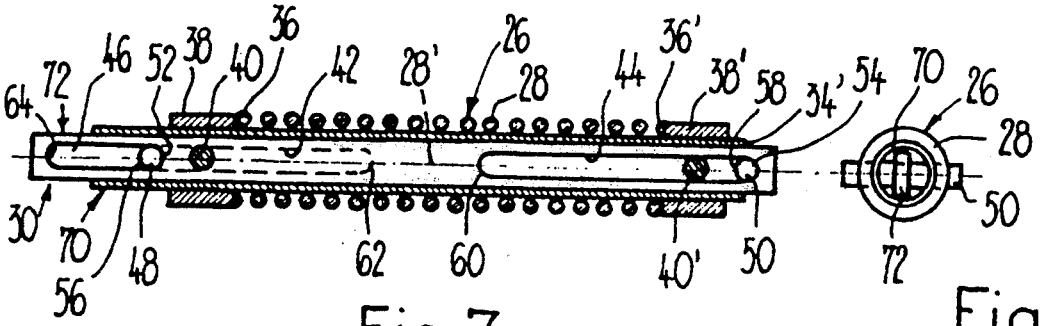
Fig. 7
Fig.8
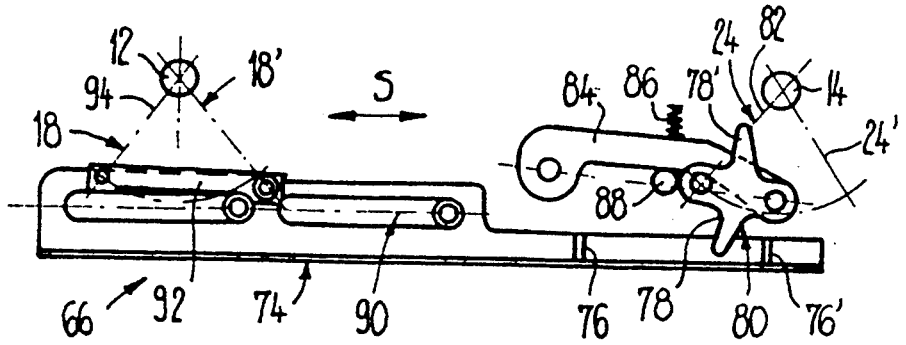
Fig.9
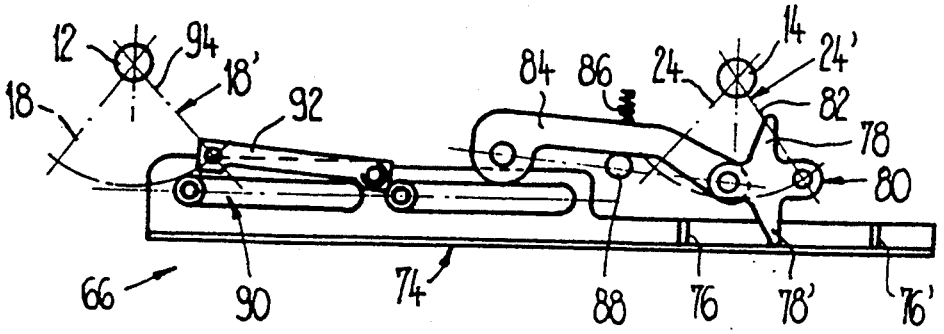
Fig.10

ACTUATOR FOR ELECTRICAL SWITCHES

FIELD OF THE INVENTION

The present invention relates to an actuator for the rapid connection and disconnection of electrical switches.

BACKGROUND OF THE INVENTION

An actuator is known from U.S. Pat. No. 4,263,487. This actuator has a primary shaft having a tension lever of twin-armed configuration, which primary shaft can be rotated manually to and fro between two end settings by hand via a crank handle. A delivery shaft, which is provided with a twin-armed drive lever and can be rotated to and fro between a disconnect and a connect setting, runs parallel to the primary shaft. Between the arms of the primary shaft and delivery shaft there is respectively disposed a compression spring of a spring-loading arrangement. The compression springs, given that the input and delivery shafts are parallel to each other, mutually counterbalancing their pre-tension. The delivery shaft is held the disconnect and connect setting counter to the force of the compression spring which can be tensioned upon the respective rotation of the primary shaft by means of a connecting or disconnecting latch acting upon the drive lever. Shortly before the primary shaft reaches the corresponding end setting, the tension lever runs into the latch concerned in order to release the drive lever and hence the delivery shaft. Following the completion of the switching maneuver, the drive lever then runs parallel again to the tension lever. For the realization of an opposite switching maneuver, the primary shaft is rotated in the opposite direction, as a result of which the other compression spring for the actuation of the delivery shaft is tensioned.

A disadvantage with this actuator is that a dedicated compression spring is respectively required for the connection and disconnection. Furthermore, the connect and disconnect setting of the delivery shaft cannot be reliably achieved by the force of the compression springs, since in these settings the effect of the two compression springs is cancelled out.

A further actuator is disclosed in DE-C-32 17 255. The primary shaft is connected via a pair of gearwheels to an intermediate shaft parallel thereto. This supports a one-armed tension lever and the likewise parallel delivery shaft possesses a drive lever. The tension lever and the drive lever are firmly connected to the spring ends of a helical spring. A locking mechanism prevents the primary shaft from being able to be rotated into its end setting unless the delivery shaft also assumes the connect or disconnect setting, the locking mechanism being configured such that the delivery shaft is automatically rotated the last few degrees into the connect and disconnect setting of the primary shaft. This ensures that the connect and disconnect settings are reached when the helical spring is slackened in these settings. A disadvantage of this actuator is that it requires an intermediate shaft, since the primary and delivery shafts must have an opposite direction of rotation.

An actuator is further known from DE-AS 1 236 632, in which the primary shaft and the delivery shaft are disposed, however, coaxially to each other. The spring-loading arrangement includes two coaxial helical springs under bending stress, in the disconnect direction only the one spring being active, whereas in the connect direction both are active, so that different drive energies are available depending upon the switching direction. If, in the disconnection operation, the delivery shaft, after the locking setting of the primary shaft has been crossed, should fail to move under the action of the spring-loading arrangement, then an enforced coupling between these shafts is brought about. A further enforced coupling ensures, in the connection operation, that the delivery shaft is brought fully into the connect setting. This actuator has a considerable structural depth in the direction of the shafts.

SUMMARY OF THE INVENTION

An object of the present invention is to provide a an actuator that, while maintaining a small structural depth, reliably provides connect and disconnect settings using a single helical spring.

This object is achieved by an actuator in which the helical spring interacts by its spring ends, via driver elements, with the tension lever and the drive lever. The helical spring is thus clamped both between the driver elements interacting with the tension lever and the driver elements interacting with the drive lever. Since, according to the invention, the helical spring is pre-tensioned, the primary and delivery shafts, irrespective of their position with respect to one another, are coupled together at least under a force corresponding to the pre-tensioning of the helical spring. As long, therefore, as the motion of the delivery shaft is counteracted by a force which is less than the pre-tensioning force of the helical spring, the two shafts are firmly coupled together. In other words, the delivery shaft is definitely forced, at least with the pre-tensioning force of the helical spring, into the connect or disconnect setting. The helical spring can be subjected to compression load or tensile load. It acts, however, in the connection operation and disconnection operation, in the same direction, namely always as a compression spring or always as a tension spring under pre-tension.

BRIEF DESCRIPTION OF THE DRAWINGS

The present invention is now explained in greater detail with reference to the drawings, in which schematic representations are presented and in which:

FIG. 7 shows, schematically, in the same representation as FIG. 1, a further embodiment of a part of the actuator;

FIG. 8 shows, schematically, that part of the actuator shown in FIG. 7, in side view;

FIG. 9 shows, schematically, a first embodiment of a locking device of the actuator where the delivery shaft is supported in the disconnect setting;

FIG. 10 shows, schematically, the locking device according to FIG. 9 where the delivery shaft is supported in the connect setting;

DETAILED DESCRIPTION OF THE PREFERRED EMBODIMENTS

Figure 1:
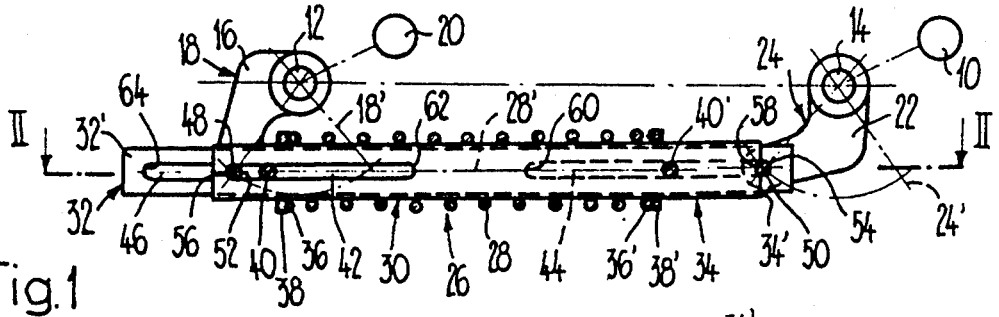
FIG. 1 shows, schematically, in projected view, a part of an actuator having a spring-loading arrangement in the disconnect setting, partly in cross-section taken along the line I—I of FIG. 2.

The actuator shown in the figures is designed for the rapid connection and disconnection of electrical switches 10 indicated diagrammatically in FIG. 1, especially on-load switches, isolating switches and grounding switches for medium and high voltage. The jump-drive has a primary shaft 12 and a distanced delivery shaft 14 parallel thereto. Seated in a rotationally secure manner on the primary shaft 12 is a tension lever 16, which is rotatable out of a first end position 18, indicated in FIG. 1 by unbroken lines and in FIG. 4 in broken lines, counter-clockwise (through an angle of about 80°) into a second end position 18', indicated in FIG. 1 in broken lines and in FIG. 4 by unbroken lines, and back again. The rotation of the primary shaft 12 is effected by the use of rotation means 20, indicated diagrammatically in FIG. 1, for example manually by means of a crank handle which can be placed onto the primary shaft 12 or electrically by means of a gear motor.

Figure 4:
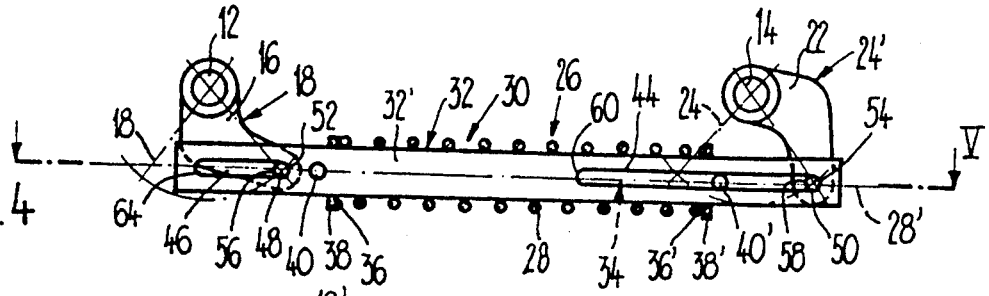
FIG. 4 shows, schematically, in projected view, that part of the actuator shown in FIG. 1, in the connect setting.

Seated in a rotationally secure manner on the delivery shaft 14 connected to the switch 10 is a drive lever 22, which is rotatable out of a disconnect setting 24, indicated in FIG. 1 by unbroken lines and in FIG. 4 in broken lines, counter-clockwise (also through an angle of about 80°) into a connect setting 24', indicated in FIG. 1 in broken lines and in FIG. 4 by unbroken lines, and back again.

Interacting with the tension lever 16 and drive lever 22 and hence with the primary shaft 12 and the delivery shaft 14 is a spring-loading arrangement 26, whose helical spring 28, acting as a compression spring, is connected via a butt strap arrangement 30 to the tension lever 16 and drive lever 22.

The butt strap arrangement 30 includes a double butt strap 32 having two identical butt straps 32' and a single butt strap 34, which is disposed between said identical butt straps 32' and is displaceable relative to these in the longitudinal direction. The helical spring 28 embraces the butt strap arrangement 30 and is supported by its spring end 36 facing the tension lever 16, via a perforated disk 38 and a pin 40, on the double butt strap 32. The pin 40 passes at right-angles to the spring axis 28' and hence at right-angles to the longitudinal direction of the butt strap arrangement 30 in a seat-tight manner through the double butt strap 32 and through an elongated recess 42 in the single butt strap 34, which recess extends in the longitudinal direction of the butt strap arrangement 30. Analogously, the spring end 36' facing the drive lever 22 is likewise supported, via a perforated disk 38' and a pin 40', on the single butt strap 34. The pin 40' passes through the butt straps 32' of the double butt strap 32 through a respective elongated recess 44, extending in the longitudinal direction of the butt strap arrangement 30, and in a seat-tight manner through the individual butt strap 34.

The butt straps 32' exhibit, at their end region on the tension lever side, a further likewise elongated recess 46, this further recess 46 and the recess 42 in the single butt strap 34 overlapping each other and, in the region of the overlap, being passed through by a driving pin 48 disposed on the tension lever 16. A further driving pin 50 is disposed on the drive lever 22; the former passes through the recess 44 in the double butt strap 32 outside the near-side end 34' of the single butt strap 34.

The butt straps 32' of the double butt strap 32 interact with the driving pin 48 via a first driving stop 52 and with the further driving pin 50 via a second driving stop 54. At the same time, the first driving stop 52 is formed by that end of the further recess 46 facing the spring end 36 and the second driving stop 54 by that end of the recess 44 facing away from spring end 36. In a diametrically opposite manner, the single butt strap 34 interacts as a first driving stop 56, by that end of its recess 42 facing away from the spring end 36', with the driving pin 48 and as a second driving stop 58, by the end 34', with the further driving pin 50.

In order, as described in greater detail further below, in the connection operation, to ensure an enforced transportation of the delivery shaft 14, the butt straps 32' of the double butt strap 32 exhibit, at that end of their recess 44 facing the tension lever 16, a stop 60 interacting with the pin 40' and the single butt strap 34 has, at that end of its recess 42 facing the drive lever 22, a stop 62 interacting with the driving pin 48. Correspondingly, that end of the further recess 46 in the double butt strap 32 which is remote from the drive lever 22 interacts, as a stop 64, with the driving pin 48 of the tension lever 16 in order, in the disconnection operation, enforcedly to take up the delivery shaft 14.

Figure 3:
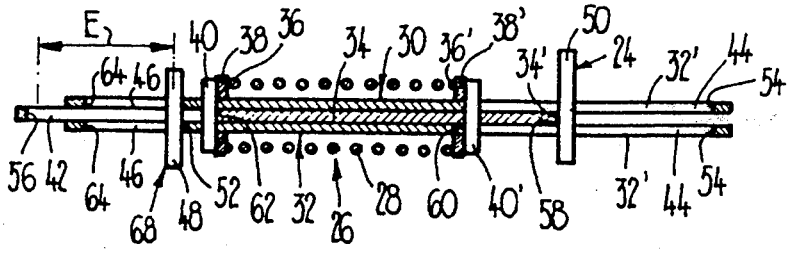
FIG. 3 shows, schematically, in the same representation as FIG. 2, that part of the actuator in the disconnect setting, where the spring-loading arrangement is tensioned prior to the release of the delivery shaft for connection purposes.
Figure 6:
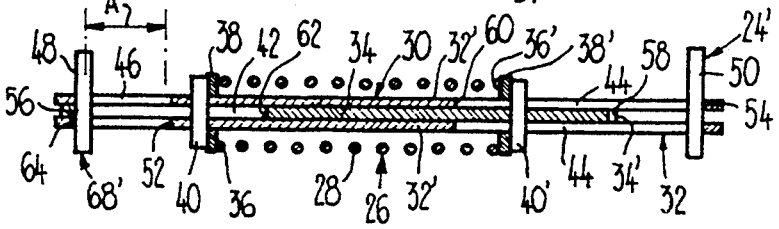
FIG. 6 shows, schematically, in the same representation as FIG. 5, that part of the actuator shown in FIG. 4 connect setting, but with the spring-loading arrangement tensioned for the disconnection, shortly before the release of the delivery shaft for disconnection purposes.

Interacting with the delivery shaft 14 is a locking device 66 controlled by the primary shaft 12, which locking device is described in greater detail further below in association with FIGS. 9 and 10. In the connection operation, this locking device 66 holds the delivery shaft 14 in its disconnect setting 24 until the primary shaft 12, when rotated from the first end position 18 in the direction of the second end position 18', reaches a connect-unlatching setting 68, as is indicated in FIG. 3 with reference to the driving pin 48 located in this setting. The length of travel which the driving pin 48 covers from the first end position 18 up to the connect-unlatching setting 68 is denoted in FIG. 3 by the double-ended arrow E. In the same way, in the disconnection operation, the delivery shaft 14 is held in the connect setting 24' until the tension lever 16 surmounts, from its second end position 18' in the direction of the first end position 18, a disconnect-unlatching setting 68', which is indicated in FIG. 6 by the driving pin 48 located in this setting. The length of travel which this driving pin 50 covers from the second end position 18' up to the disconnect-unlatching setting 68' is denoted in this figure by the double-ended arrow A. Since the connection of the switch 10 requires more energy than the disconnection, the length of travel E is greater than the length of travel A.

FIGS. 7 and 8 show the spring-loading arrangement 26 with another possible embodiment of the butt strap arrangement 30. The difference relative to the butt strap arrangement 30 shown in FIGS. 1 to 6 is that the single butt strap 34 is now configured as a tube 70 and the double butt strap 32 as a single butt strap 72 passing through the tube 70. Correspondingly, the recess 42 which interacts with the pins 40, 40', the driving pin 48 and further driving pin 50 is formed on the tube 70 and the recess 44 and further recess 46 on the butt strap 72. That end of the tube 70 located on the delivery shaft side and the axial ends of the recesses 42, 44, 46 on the tube 70 and on the butt strap 72 act in the same way as in the embodiment according to FIGS. 1 to 6, as driving stops 52, 54, 56, 58 and stops 60, 62, 64. Reference is made in this regard to the description given above.

The locking device 66 shown in FIGS. 9 and 10 has a control slide 74, which can be moved to and fro in the direction of the double-ended arrow S and which interacts, by its two control cams 76, 76', with two mutually opposing control bosses 78, 78' of a cruciformly configured trip lever 80. The trip lever 80 is attached, at one end, to a retaining lever 82 seated in a rotationally secure manner on the delivery shaft 14 and, at the other end, is connected in an articulated manner to the free end of a fixed-mounted rocker 84. The rocker 84 is forced by a compression spring 86 against a stop pin 88, so that the rocker 84, bearing against the stop pin 88, and the trip lever 80, when the delivery shaft 14 is located in the disconnect setting 24 and in the connect setting 24', are located in an over-dead-center position.

The control slide 74 which is displaceably guided, by means of an elongated guide-pin guide 90, parallel to the spring axis 28' and to the longitudinal extent of the butt strap arrangement 30 is attached via a connecting link 92 to a control lever 94 seated in a rotationally secure manner on the primary shaft 12. In FIG. 9, the control slide 74 is shown in its setting corresponding to the first end position 18 of the primary shaft 12, in which setting the delivery shaft 14 is located in the disconnect setting 24. In relation to this setting, when the primary shaft 12 is brought into the second end position 18', the control slide 74 is displaced into a corresponding setting shown in FIG. 10. In FIG. 10, the mutual dead center position of the trip lever 80 and of the rocker 84 is shown in the connect setting 24'. In the disconnect setting 24, the first control boss 78 protrudes into the motional path of the first control cam 76 (FIG. 9), in the same way the second control boss 78' reaches, in the connect setting 24', into the motional path of the second control cam 76' (FIG. 10).

The locking device 66 operates as follows: if, for the connection of the switch 10, the primary shaft 12 is twisted out of its first end position 18 (FIG. 9) counter-clockwise in the direction of the second end position 18', the first control cam 76 runs onto the first control boss 78 and takes this up, thereby giving rise to the counter-clockwise rotation of the trip lever 80 about its connecting spigot to the retaining lever 82. The rocker 84 is raised here from the stop pin 88 counter to the force of the compression spring 86. As soon as the primary shaft 12 reaches the connect-unlatching setting 68 (compare FIG. 3), the axis of the connecting spigot crosses the straight line between the bearing axle of the rocker 84 and its connection to the trip lever 80, this being equivalent to the crossing of the dead center position. The delivery shaft 14 is thereby released, so that it swivels, under the force of the spring-loading arrangement 26, into the connect setting 24'. The trip lever 80 also rotates here about the attachment to the rocker 84, through somewhat more than 180°, into the other over-dead-center position shown in FIG. 10, in which the delivery shaft 14 is prevented from rotating in the direction of the disconnect setting 24. For the disconnection operation, the primary shaft 12 is pivoted out of its second end position 18' clockwise in the direction of the first end position 18. The second control cam 76' runs here onto the second control boss 78' and carries this along, thereby resulting in the rotation of the trip lever 80, now in the clockwise direction, about the attachment to the retaining lever 82. At the same time, the rocker 84 is raised once again from the stop pin 88. As soon as the primary shaft 12 has reached the disconnect-unlatching setting 68' (FIG. 6), the axis of said connection crosses over the extension of the straight lines between the bearing axle of the rocker 84 and its attachment to the trip lever 80, so that the mutual dead center position is now eliminated. Under the force of the spring-loading arrangement 26, the delivery shaft 14 is now pivoted back into the disconnect setting 24, thereby giving rise to a rotation of the trip lever 80 into the position shown in FIG. 9.

Figure 11:
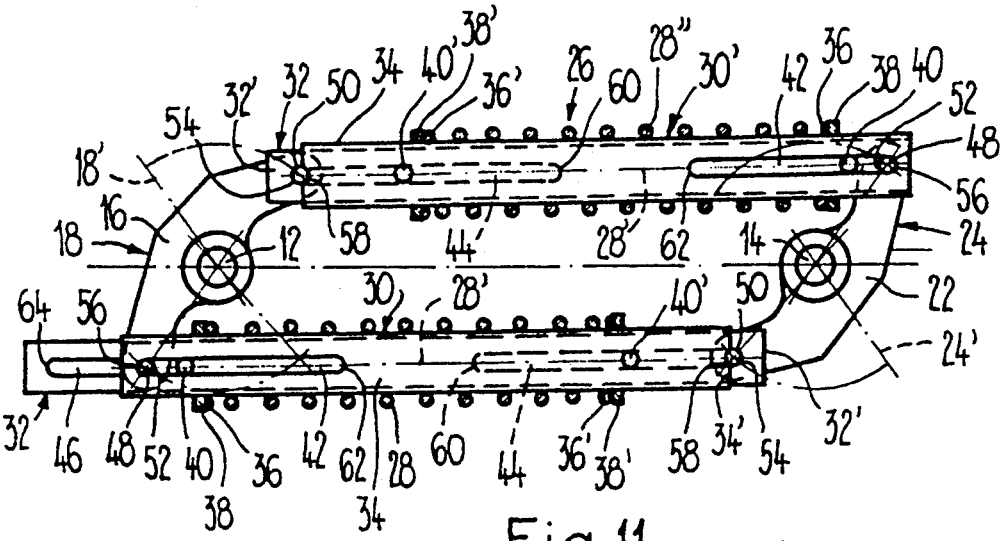
FIG. 11 shows, schematically, in the same representation as in FIG. 1, an embodiment of the actuator having two helical springs in the disconnect setting.
Figure 12:
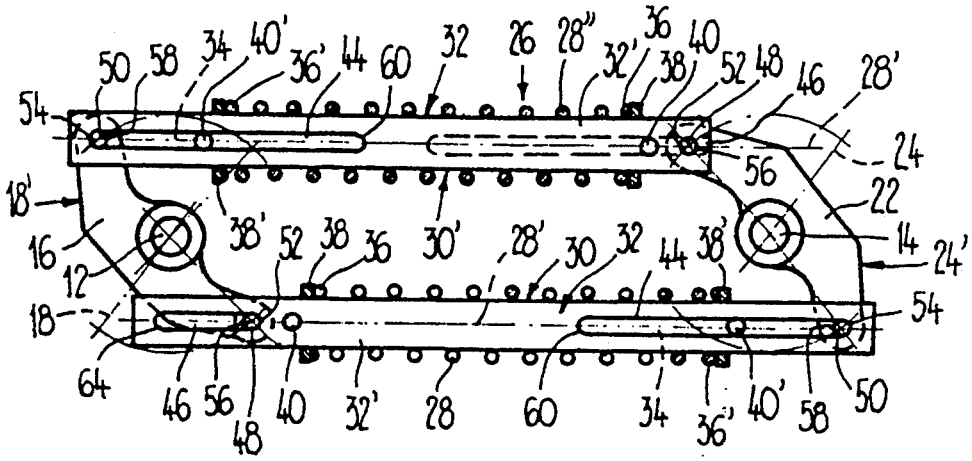
FIG. 12 shows, schematically, in projected view, the embodiment according to FIG. 11 in the connect setting.

FIGS. 11 and 12 show, in the same representation as FIGS. 1 and 4 respectively, a actuator, having a spring-loading arrangement 26 with two helical springs 28, 28''. The tension lever 16 seated on the primary shaft 12 and the drive lever 22 disposed on the delivery shaft 14 are of twin-armed configuration and each helical spring 28, 28'' acting as a compression spring interacts, via the corresponding butt strap arrangement 30, 30', with the corresponding arms of the tension lever 16 and of the drive lever 22. The butt strap arrangement 30, which is assigned in FIGS. 11 and 12 to the lower helical spring 28, is identical to the butt strap arrangement shown in FIGS. 1 to 6. The butt strap arrangement 30', which is in each case shown at the top, also substantially corresponds in its construction to the lower butt strap arrangement 30, though being inversely disposed, so that, in the case of the lower spring-loading arrangement 26 and lower butt strap arrangement 30, that region facing the tension lever 16 is now facing the drive lever 22 and vice versa. In the connection operation, the lower spring-loading arrangement 26 and the butt strap arrangement 30 thus operate in the same way as the arrangement shown in FIGS. 1 to 6 in the connection operation, whereas here the spring-loading arrangement 26 and butt strap arrangement 30 shown at the top in FIGS. 11 and 12 display the same action in the connection operation as the arrangement according to FIGS. 1 to 6 in the disconnection operation. The only constructional difference consists in the fact that, in the case of the upper butt strap arrangement 30, the further recess 46 of the single butt strap 34 is not configured like an elongated recess but is configured as a recess which is open at the near-side end of the single butt strap 34. The enforced transportation of the delivery shaft in the disconnection operation is effected by the further recess 46 of the double butt strap 32 of the lower butt strap arrangement 30.

Figure 13:
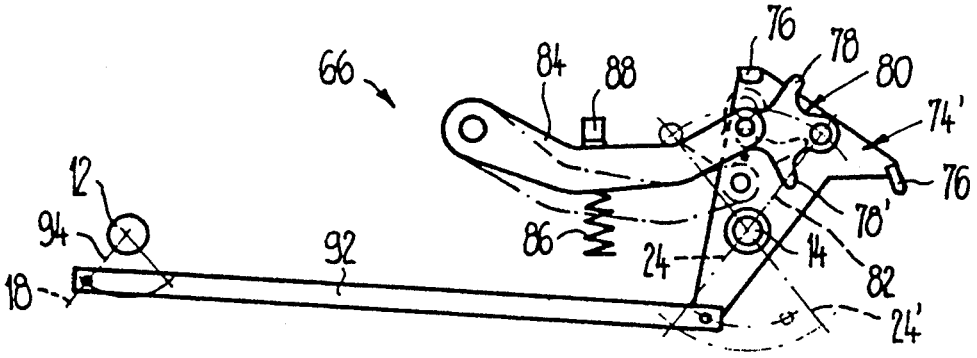
FIG. 13 shows, schematically, a second embodiment of the locking device where the delivery shaft is supported in the disconnect setting.
Figure 14:
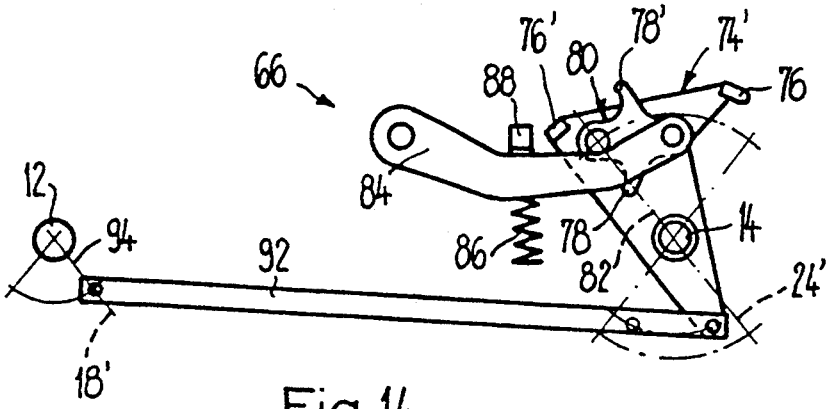
FIG. 14 shows, schematically, the locking device according to FIG. 13 where the delivery shaft is supported in the connect setting.

The embodiment of the locking device 66 which is shown in FIGS. 13 and 14 has a twin-armed control lever 74' which is mounted freely rotatably on the delivery shaft 14 and which interacts, by its two control cams 76, 76' disposed on a lever arm, with the two mutually opposing control bosses 78, 78' of the cruciform trip lever 80. The retaining lever 82, which is seated in a rotationally secure manner on the delivery shaft 14, is pivotably connected to the one end of the trip lever 80, which is attached in turn, by its other end, to the fixed-mounted rocker 84. The rocker 84, in contrast to the embodiment according to FIGS. 9 and 10, is forced by the compression spring 86 in the upward direction against the stop pin 88, so that the rocker 84, bearing against the stop pin 88, and the trip lever 80, when the delivery shaft 14 is located in the disconnect setting 24 (FIG. 13) and the connect setting 24' (FIG. 14), are once again located in an over-dead-center position.

Connecting link 92 connects the primary shaft 12 to the control lever 74', in that the former is attached, at the one end, to the control lever 94 which is seated in a rotationally secure manner on the primary shaft 12 and, at the other end, to that lever arm of the control lever 74' which is remote from the control cams 76, 76'.

The basic working method of this embodiment of the locking device 66 is identical to that according to FIGS. 9 and 10. In FIG. 13, the control lever 74' is located in its setting corresponding to the first end position 18 of the primary shaft 12 and the delivery shaft 14 is located in the disconnect setting 24. When the primary shaft 12 is pivoted counter-clockwise into the second end position 18' shown in FIG. 14, the control lever 74' is also jointly pivoted counter-clockwise. The, in this case, following control cam 76 runs onto the corresponding control boss 78 and carries this along, the trip lever 80 being twisted counter-clockwise about its attachment to the retaining lever 82. As soon as the trip lever 80 and the rocker 84 now cross their mutual dead center position, the delivery shaft 14 is released, so that it pivots, under the force of the spring-loading arrangement 26 (compare FIGS. 1 to 7, 11, 12), into the connect setting 24'. At the same time, the rocker 84 and the trip lever 80 enter into their other over-dead-center position shown in FIG. 14.

For the connection operation, the primary shaft 12 is rotated clockwise out of its second end position 18', with the effect that the control cam 76' now runs onto the control boss 78' and carries this along until the trip lever crosses its dead center position with the rocker 84. The delivery shaft 14 is thereby released for the disconnection operation.

Figure 2:
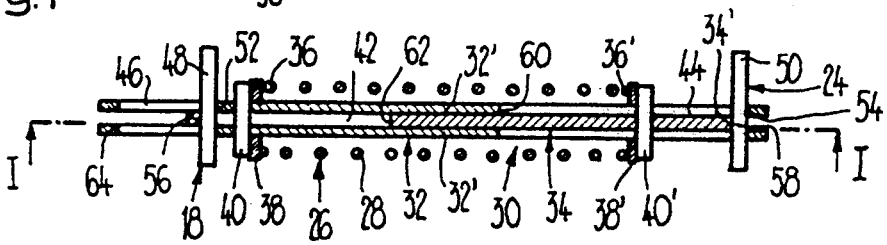
FIG. 2 shows, schematically, that part of the actuator shown in FIG. 1 in a cross-sectional view taken along the line II—II of FIG. 1.

The working method of the actuator according to the invention is as follows: if the primary shaft 12 is located in its first end position 18 and the delivery shaft 14 in the disconnect setting 24, as shown by FIGS. 1 and 2 or 11, the spring end 36 of the pre-tensioned helical spring 28 is supported, via the first driving stop 52 of the double butt strap 32, on the driving pin 48 of the tension lever 16 on the one hand and the other spring end 46', via the first driving stop 56 of the single butt strap 34, on the driving pin 48 on the other hand. Furthermore, the double butt strap 32 lies with the second driving stops 54 against the further driving pin 50 on the one hand and the single butt strap 34 with its second driving stop 58 against the further pin 50 on the other hand. The disconnect setting 24 of the delivery shaft 14 is thereby obtained.

If now, for the connection operation, the primary shaft 12 is rotated counter-clockwise, the double butt strap 32, which bears with its first driving stop 52 against the driving pin 48, is carried along, so that the near-side spring end 36 is moved in the direction of the spring axis 28' up to the other spring end 36' for the further tensioning of the helical spring 28. The spring end 36' is unable to yield, since the single butt strap 34 presses with its second driving stop 58 against the further driving pin 50. Said driving pin, due to the locking device 66 blocking the delivery shaft 14, as is shown in FIGS. 9 or 11, is unable to yield. When the connect-unlatching setting 68 (FIG. 3) is reached by the tension lever 16, the helical spring 28, 28" is further tensioned according to the length of travel E. The stored spring energy is now available for the connection of the switch 10. In the connect-unlatching setting 68, the locking device 66 releases the delivery shaft 14, thereby resulting in rapid connection as the delivery shaft 14 is brought into the connect setting 24'. The helical spring 28, 28" slackens here by the length of travel E back to its pre-tensioning, as can be clearly seen from FIGS. 4 and 5 in comparison to FIGS. 1 and 2.

The connect-unlatching setting 68 is located not far in front of the second end position 18' of the primary shaft 12.

If now, when the connect-unlatching setting 68 is crossed, the delivery shaft 14, following its release by the locking device 66, should fail to move for any reason, the stops 60 run onto the pin 40' and the pin 40 onto the stop 62, thereby resulting in an enforced transportation of the further driving pin 50 and hence of the delivery shaft 14 by the second driving stop 58 of the single butt strap 34, until the primary shaft 12 has reached the second end position 18'.

Figure 5:
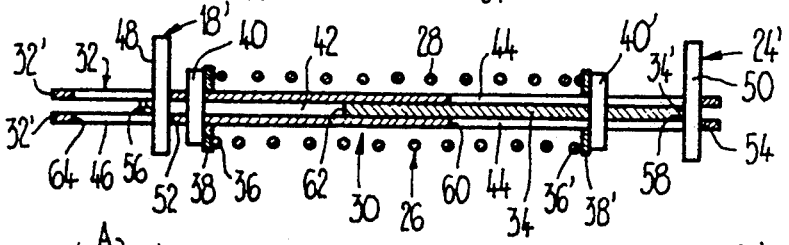
FIG. 5 shows, schematically, the part of the actuator shown in FIG. 4, in a cross-sectional view taken along the line V—V of FIG. 4.

For the disconnection operation, the primary shaft 12 is rotated clockwise out of the second end position 18' shown in FIGS. 4 and 5 in the direction of the first end position 18. At the same time, the spring end 36' is carried along by the single butt strap 34, bearing with its first driving stop 56 against the driving pin 48, in the direction of the spring axis 28' up to the spring end 36. This results once again in the further tensioning of the helical spring 28, 28", according to the length of travel A, up to the disconnect- unlatching setting 68', compare FIG. 6. The length of travel A is less than the length of travel E, if the energy required for the disconnection of the switch 10 is less than the energy required for the connection operation. In the disconnect-unlatching setting 68', the locking device 66 releases the delivery shaft 14, after which the latter, under the force of the helical spring 28, 28", moves clockwise out of the connect setting 24' in the direction of the disconnect setting 24. The double butt strap 32 here comes to bear again, with its first driving stops 52, against the driving pin 48 and the further driving pin 50 runs onto the second driving stop 58 of the single butt strap 34. The energy which is not required for the disconnection operation is absorbed here again by the helical spring 28. The need for a disconnect brake is therefore obviated. Since the rotation speed of the primary shaft 12 is generally substantially less than the speed of the delivery shaft 14 in the switching operation, the delivery shaft 14 is afterwards moved synchronously with the primary shaft 12 into the disconnect setting 24, when said primary shaft is returned fully into the first end position 18. The circuit breaker is now ready again to make a connection.

If, in the disconnection operation, the delivery shaft 14, following its release by the locking device 66, should fail to move out of the connect setting 24', said delivery shaft is once again coupled, for enforced transportation, to the primary shaft 12, in that the driving pin 48 runs onto the stops 64 of the double butt strap 32 and, by means thereof, with the second driving stops 54, carries along the further driving pin 50.

If, in the connection and/or disconnection operations, the enforced coupling of the delivery shaft 14 to the primary shaft 12 can be dispensed with, the stops 60 and 62 or the stop 64 can be omitted, this being realizable by corresponding lengthening of the recesses 42, 44 and of the further recess 46. Where appropriate, this further recess 46 can be of open configuration, as is shown at the top in FIGS. 11 and 12.

The tension lever 16 can also of course be used as a control lever for the latch device 66. The connecting link 92 is in this case attached directly to the tension lever 16. In the same way, the drive lever 22 can also serve as a retaining lever. The attachment of the trip lever 80 is made in this case to the drive lever 22.

It is also possible, in a spring-loading arrangement having two helical springs, to activate only one helical spring respectively for the connection or disconnection operation. For this purpose, the corresponding driving stops on the double butt strap or single butt strap, for example, are omitted.

It is also possible for the control cams to be disposed on the control slide in such a way that their position can be adjusted. This allows the energy of the spring-loading arrangement to be matched to the individual switch.

While the invention has been described above with respect to certain embodiments thereof, variations and modifications may be made without departing from the spirit and scope of the invention.

What is claimed is:

1. An actuator for rapid connection and disconnection of at least one of an electrical switch, an on-load switch, an isolating switch and a ground-switch for medium and high voltages, comprising:

a primary shaft having a tension lever, said primary shaft being rotatable between a first end setting and a second end setting;

a delivery shaft parallel to said primary shaft and having a drive lever, said delivery shaft being rotatable between a disconnect setting and a connect setting;

first driver elements interacting with the tension lever;

second driver elements interacting with the drive lever;

means for providing a spring load and including at least one helical spring, having spring ends movable relative to each other in an axial direction of the at least one helical spring, interacting with the tension lever and the drive lever, one of said spring ends being connected to one of said first driver elements and to one of said second driver elements, another one of said spring ends being connected to another one of said first driver elements and to another one of said second driver elements, the at least one helical spring being held, pre-tensioned, between the first driver elements and the second driver elements; and a locking device for detachably supporting the delivery shaft in the disconnect setting and the connect setting against the spring load provided by the means for providing a spring load;

wherein said means for providing a spring load is tensioned, upon rotation of the primary shaft from one of the first and second end settings in a direction of the other of the first and second end settings, until a corresponding unlatching setting of the primary shaft, preceding the other end setting, is reached, and the locking device detaches its support of the delivery shaft when the primary shaft is in said corresponding unlatching setting.

2. An actuator as claimed in claim 1, and further comprising means for activating enforced movement of the delivery shaft by the primary shaft after said corresponding unlatching setting has been passed by the primary shaft.

3. An actuator as claimed in claim 1, and further comprising a butt strap supporting one of the spring ends, each butt strap comprising said driver elements interacting with the tension lever and the drive lever.

4. An actuator as claimed in claim 3, wherein the means for activating the enforced movement of the delivery shaft include a stop disposed on each butt strap said stop being distanced from a counter-stop interacting therewith over a length of travel from a corresponding end setting up to the unlatching setting.

5. An actuator as claimed in claim 4, and further comprising driving members disposed on at least one of the tension lever and the drive lever, wherein each butt strap is embraced by the helical spring and comprises an elongated recess through which at least one of said driving members passes, said driving members interacting with the driver elements at an end of the recess.

6. An actuator as claimed in claim 3, wherein said butt strap is one of a pair of butt straps and is formed by a tube through which the other of the pair of butt straps passes.

7. An actuator as claimed in claim 1, wherein the at least one helical spring moves in a first tensioning path in one switching direction up to the corresponding unlatching setting which is shorter than a second tensioning path in the other switching direction so that the at least one helical spring absorbs energy which is not required by the switch.

8. An actuator as claimed in claim 1, and further comprising a twin-armed tension lever, wherein the means for providing a spring load includes two helical springs which respectively interact with an arm of said tension lever, said twin-armed tension lever and the drive lever, one of said two helical springs interacting, by one of its spring ends, via a single driver, with one of the tension lever and the drive lever.

9. An actuator as claimed in claim 1, wherein the locking device comprises a rocker and a trip lever pivotably mounted on said rocker and connected to the delivery shaft and said trip lever can be actuated from the primary shaft, the rocker and the trip lever being located, in locking settings, in a mutual dead center position.

10. An actuator as claimed in claim 9, and further comprising a control element connected to the primary shaft and including control cams, wherein the trip lever comprises control bosses which interact with control cams.

* * * * *